US005370192A

United States Patent [19]

Evinger

[11] Patent Number: 5,370,192

[45] Date of Patent: Dec. 6, 1994

[54] ONE PIECE COMBINATION CHISEL/HAMMER/CROWBAR DEVICES

[76] Inventor: Morgan R. Evinger, 37503 E. J W Cummins Rd., Oak Grove, Mo. 64075

[21] Appl. No.: 192,356

[22] Filed: Feb. 7, 1994

[51] Int. Cl.[5] ..... B25D 1/02; E02D 7/04

[52] U.S. Cl. ..... 173/90; 173/132

[58] Field of Search ..... 173/90, 91, 128, 132

[56] References Cited

U.S. PATENT DOCUMENTS

| | | | |
|---|---|---|---|
| 3,117,378 | 1/1964 | Bowen | 173/90 |
| 3,519,087 | 7/1970 | Santi | 173/91 |
| 4,310,057 | 1/1982 | Brame | 173/91 |
| 4,624,323 | 11/1986 | Burrola | 173/90 |
| 5,097,912 | 3/1992 | Bowers | 173/90 |

*Primary Examiner*—Scott A. Smith

[57] ABSTRACT

A one piece combination chisel/hammer/crowbar device comprising a linear lower rod of a solid circular cross-sectional configuration fabricated of a rigid hard material and having an upper end and a lower end with a planar striking surface at the upper end and a linear chisel point at the lower end; a hollow tube with a circular cross-sectional configuration fabricated of a rigid hard material and having an upper end and a lower end with external threads at its upper end, the interior diameter being such as to be slidably received over the linear lower rod at the lower end of the tube and an apertured cap having internal screw threads positionable over the upper end of the tube and providing a bearing surface on the lower edge thereof; a linear upper rod of a solid cross-sectional configuration fabricated of a rigid hard material and having an upper end and a lower end with the lower end having an enlarged head with a planar striking surface for striking the striker surface, the enlarged head being such as to be slidably received within the tube with the upper end of the upper rod extending above the upper end of the tube, the upper end of the upper rod being formed with internal threads and external threads; and an enlarged handle having external threads at its lower end threadedly received in the screw threads at the upper end of the upper rod and an enlarged collar at its upper end and a nut with enlarged threads over the exterior threads of the upper rod and reduced threads over the threads of the handle.

3 Claims, 4 Drawing Sheets

ONE PIECE COMBINATION CHISEL/HAMMER/CROWBAR DEVICES

BACKGROUND OF THE INVENTION

1. Field of the Invention

The present invention relates to one piece combination chisel/hammer/crowbar devices and more particularly pertains to chiseling, hammering, crowbarring with a one piece combination device.

2. Description of the Prior Art

The use of combination tools is known in the prior art. More specifically, combination tools heretofore devised and utilized for the purpose of performing construction tasks are known to consist basically of familiar, expected, and obvious structural configurations, notwithstanding the myriad of designs encompassed by the crowded prior art which has been developed for the fulfillment of countless objectives and requirements.

The prior art discloses a large number of combination tools. By way of example, note U.S. Pat. No. 4,042,210 to Feldmann which discloses an adjustable leverage pry bar.

U.S. Pat. No. 5,044,033 to Fosberg discloses a forcible entry tool.

U.S. Pat. Nos. 5,085,281 to Selly and 5,109,739 to Hull disclose a slide hammer apparatus.

Lastly, U.S. Pat. No. Des. 272,712 to Allen discloses the design for a combined slide hammer, nail puller and building wrecking tool.

In this respect, the one piece combination chisel/hammer/crowbar device according to the present invention substantially departs from the conventional concepts and designs of the prior art and in doing so provides an apparatus primarily developed for the purpose of chiseling, hammering, crowbarring with a one piece combination device.

Therefore, it can be appreciated that there exists a continuing need for new and improved one piece combination chisel/hammer/crowbar devices which can be used for chiseling, hammering, crowbarring with a one piece combination device. In this regard, the present invention substantially fulfills this need.

SUMMARY OF THE INVENTION

In view of the foregoing disadvantages inherent in the known types of combination tools now present in the prior art, the present invention provides an improved one piece combination chisel/hammer/crowbar device. As such, the general purpose of the present invention, which will be described subsequently in greater detail, is to provide a new and improved one piece combination chisel/hammer/crowbar device and method which has all the advantages of the prior art and none of the disadvantages.

To attain this, the present invention essentially comprises a new and improved one piece combination chisel/hammer/crowbar device comprising, in combination, a linear lower rod of a solid circular cross-sectional configuration fabricated of a rigid hard material and having an upper end and a lower end with a planar striking surface at the upper end and a linear chisel point at the lower end; a hollow tube with a circular cross-sectional configuration fabricated of a rigid hard material and having an upper end and a lower end with external threads at its upper end, the interior diameter being such as to be slidably received over the linear lower rod at the lower end of the tube and an apertured cap having internal screw threads positionable over the upper end of the tube and providing a bearing surface on the lower edge thereof; a linear upper rod of a solid cross-sectional configuration fabricated of a rigid hard material and having an upper end and a lower end with the lower end having an enlarged head with a planar striking surface for striking the striker surface, the enlarged head being such as to be slidably received within the tube with the upper end of the upper rod extending above the upper end of the tube, the upper end of the upper rod being formed with internal threads and external threads; an enlarged handle having external threads at its lower end threadedly received in the screw threads at the upper end of the upper rod and an enlarged collar at its upper end and a nut with enlarged threads over the exterior threads of the upper rod and reduced threads over the threads of the handle; and a spike tip positioned at the lower end of the lower rod with external threads located thereabove and a removable attachment component with the chisel point, the attachment component having a recess at its upper extent with internal screw threads engagable by the threads above the spike tip for coupling therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved one piece combination chisel/hammer/crowbar devices which have all the advantages of the prior art combination tools and none of the disadvantages.

It is another object of the present invention to provide new and improved one piece combination chisel/hammer/crowbar devices which may be easily and efficiently manufactured and marketed.

It is further object of the present invention to provide new and improved one piece combination chisel/hammer/crowbar devices which are of durable and reliable constructions.

An even further object of the present invention is to provide new and improved one piece combination chisel/hammer/crowbar devices which are susceptible of a low cost of manufacture with regard to both materials and labor, and which accordingly are then susceptible of low prices of sale to the consuming public, thereby making such one piece combination chisel/hammer/crowbar devices economically available to the buying public.

Still yet another object of the present invention is to provide new and improved one piece combination chisel/hammer/crowbar devices which provide in the apparatuses and methods of the prior art some of the advantages thereof, while simultaneously overcoming some of the disadvantages normally associated therewith.

Lastly, it is an object of the present invention to provide a one piece combination chisel/hammer/crowbar device comprising a linear lower rod of a solid circular cross-sectional configuration fabricated of a rigid hard material and having an upper end and a lower end with a planar striking surface at the upper end and a linear chisel point at the lower end; a hollow tube with a circular cross-sectional configuration fabricated of a rigid hard material and having an upper end and a lower end with external threads at its upper end, the interior diameter being such as to be slidably received over the linear lower rod at the lower end of the tube and an apertured cap having internal screw threads positionable over the upper end of the tube and providing a bearing surface on the lower edge thereof; a linear upper rod of a solid cross-sectional configuration fabricated of a rigid hard material and having an upper end and a lower end with the lower end having an enlarged head with a planar striking surface for striking the striker surface, the enlarged head being such as to be slidably received within the tube with the upper end of the upper rod extending above the upper end of the tube, the upper end of the upper rod being formed with internal threads and external threads; and an enlarged handle having external threads at its lower end threadedly received in the screw threads at the upper end of the upper rod and an enlarged collar at its upper end and a nut with enlarged threads over the exterior threads of the upper rod and reduced threads over the threads of the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
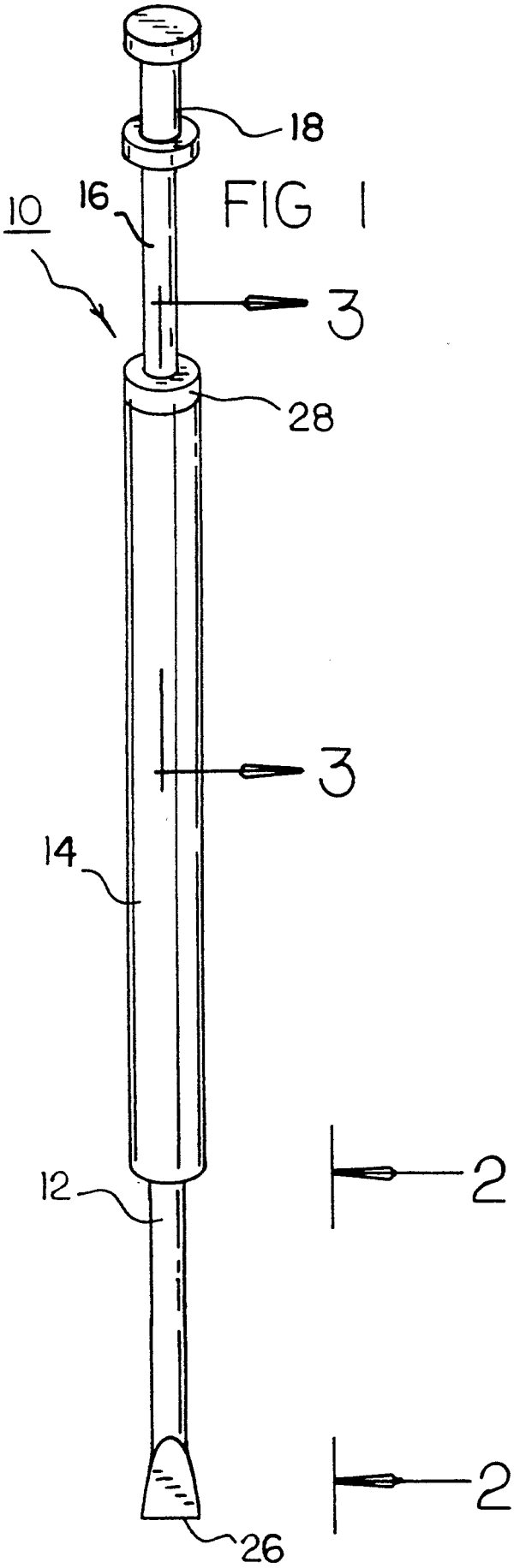
FIG. 1 is a perspective illustration of the preferred embodiment of the one piece combination chisel/hammer/crowbar devices constructed in accordance with the principles of the present invention.
Figure 2:
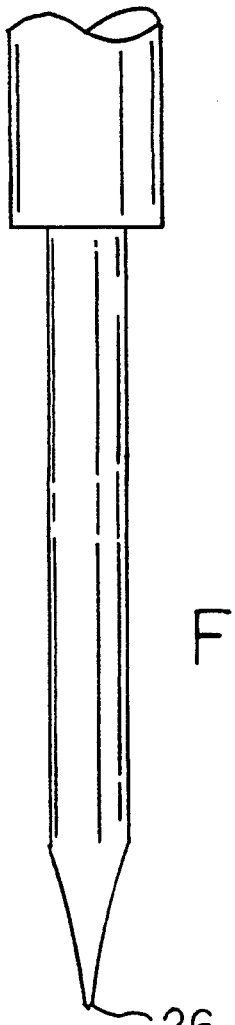
FIG. 2 is a side elevational view of the lower end of the device shown in FIG. 1.
Figure 3:
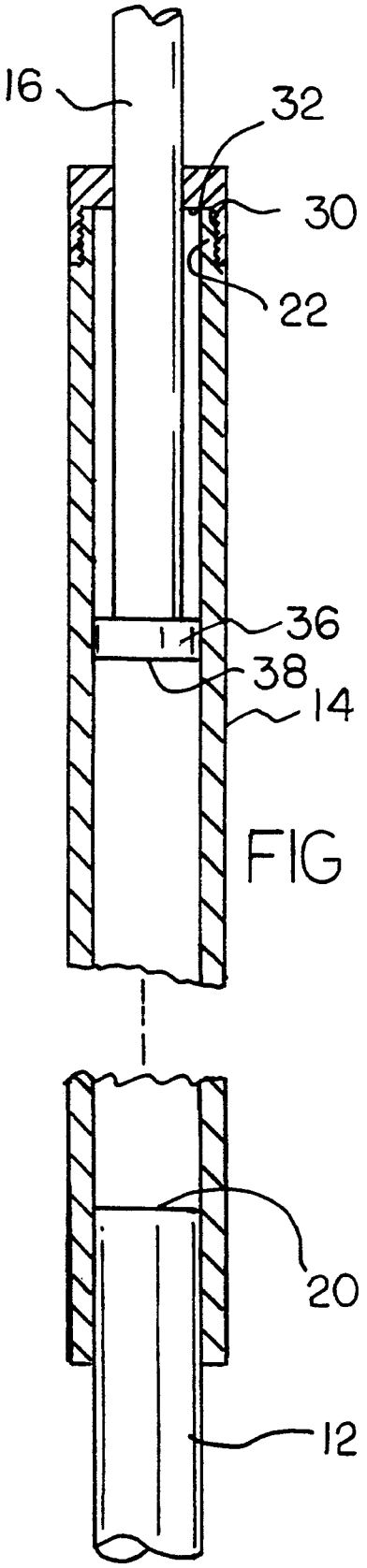
FIG. 3 is a cross-sectional view of the device taken along line 3—3 of FIG. 1.
Figure 4:
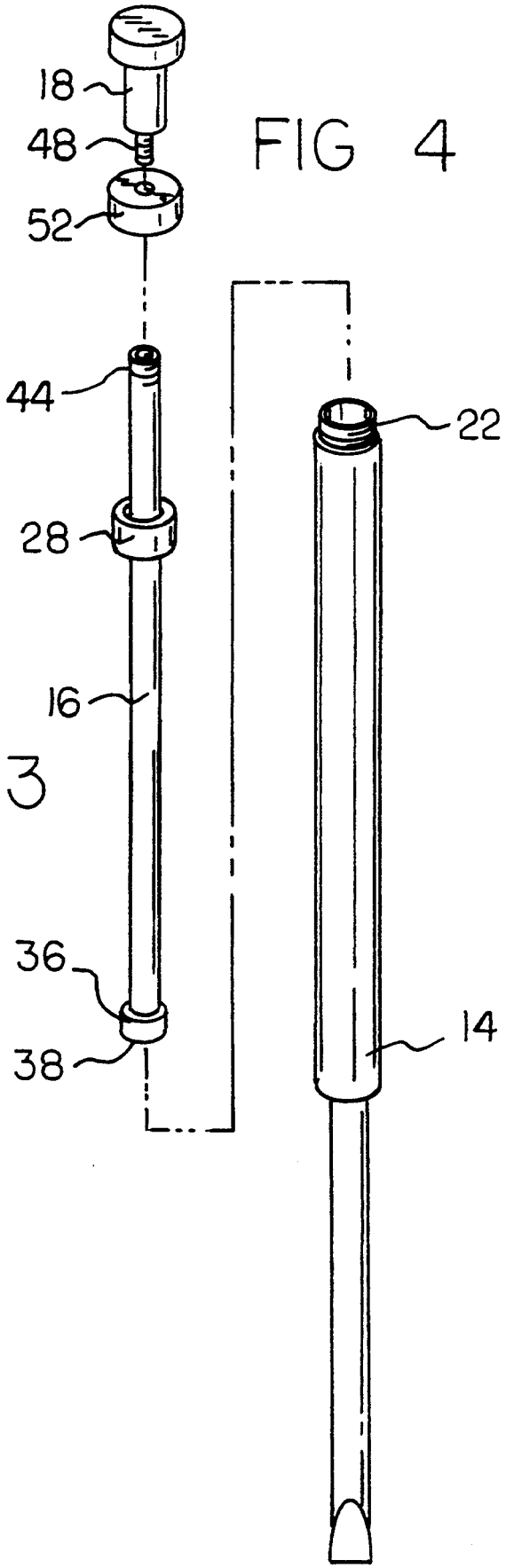
FIG. 4 is an exploded perspective view of the device shown in FIG. 1.

With reference now to the drawings, and in particular to FIG. 1 thereof, the preferred embodiment of the new and improved one piece combination chisel/hammer/crowbar device embodying the principles and concepts of the present invention and generally designated by the reference numeral 10 will be described.

Specifically, it will be noted in FIGS. 1 through 4 that the present invention is in a new and improved one piece combination chisel/hammer/crowbar device 10. In its broadest context, the device includes an interior lower rod 12, and exterior tube 14, an interior upper rod 16, an enlarged handle 18 and various coupling components therebetween.

More specifically, the linear lower rod 12 consists of a solid circular cross-sectional configuration. It is fabricated of a rigid material, preferably high carbon steel. It has an upper end and a lower end. In addition, the upper end of the rod 12 has a planar striker surface 20 adapted to receive a striking force and convey such force to the linear chisel point 26. Such chisel point 26 is formed at the lower end.

The second major component of the device 10 is a hollow tube 14. The tube has a circular cross-sectional configuration. It is fabricated of a rigid hard material, preferably high carbon steel. It has an upper end and a lower end with external screw threads 22 at its upper end. The interior diameter is such as to be slidably received over the lower rod 12 at the lower end of the tube 14.

Next provided is a linear upper rod 16. The upper rod is formed with a solid cross-sectional configuration. It is fabricated of a rigid hard material and includes an upper end and a lower end. The lower end is formed with an enlarged head 36 configured into a planar striking surface 38. Such striking surface 38 is for striking the striker surface 20 of the lower rod 12. The enlarged head 36 is of such size as to be slidably received within the tube 14 with the upper end of the upper rod extending above the upper end of the tube. In addition, the upper end of the upper rod 16 is formed with internal threads 42 and external threads 44.

An enlarged handle 18 is formed with external screw threads 48 at its lower end. The handle 18 is threadably received into the threads 42 at the upper end of the upper rod. The handle 18 provides a circumferential surface for being grasped to drive the upper rod into the lower rod during operation and use. The handle also has an upper planar surface for being struck as by a hammer, again for applying a force to the chisel point 26.

The lower end of the handle 18 includes a nut 52. The nut has enlarged internal threads 54. Such threads are engagable over the exterior threads 44 of the upper rod. The nut also has internal threads 56 of a reduced diameter which are engagable over the threads 48 of the handle.

Figure 5:
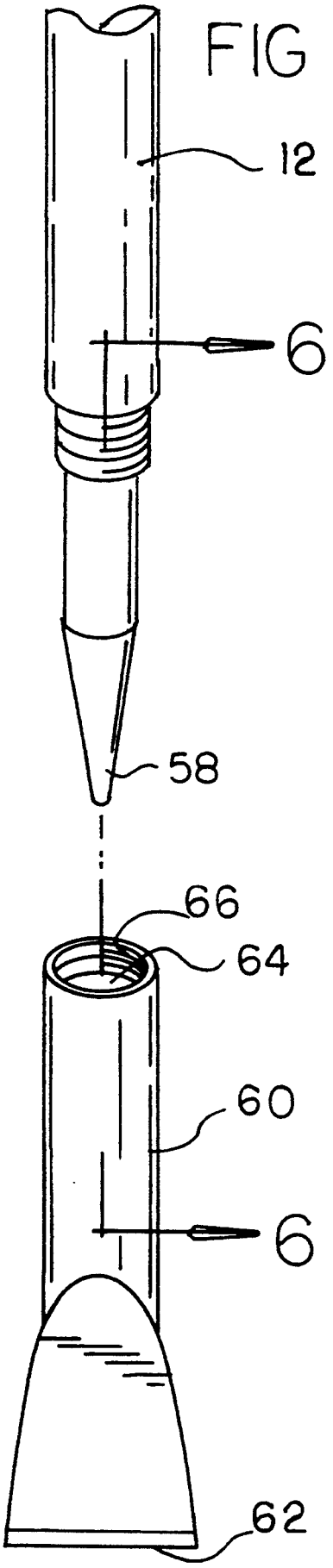
FIG. 5 is a perspective illustration of an alternate embodiment of the invention.
Figure 6:
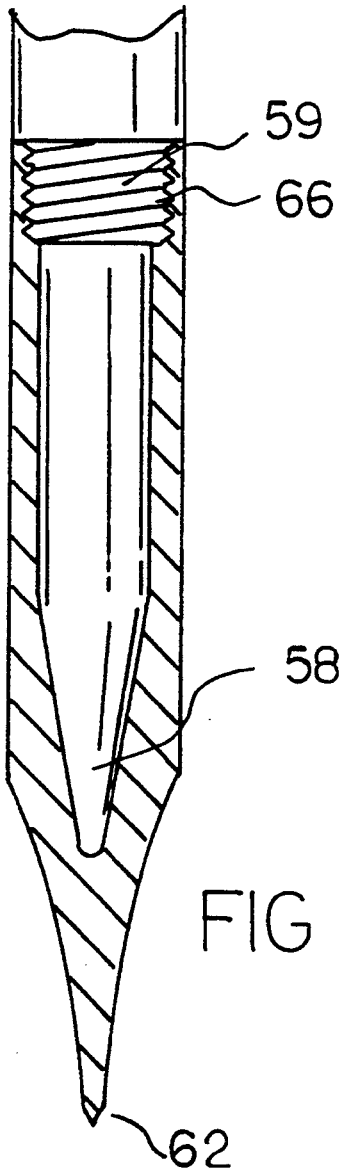
FIG. 6 is a cross-sectional view taken along line 6—6 of FIG. 5.
Figure 7:
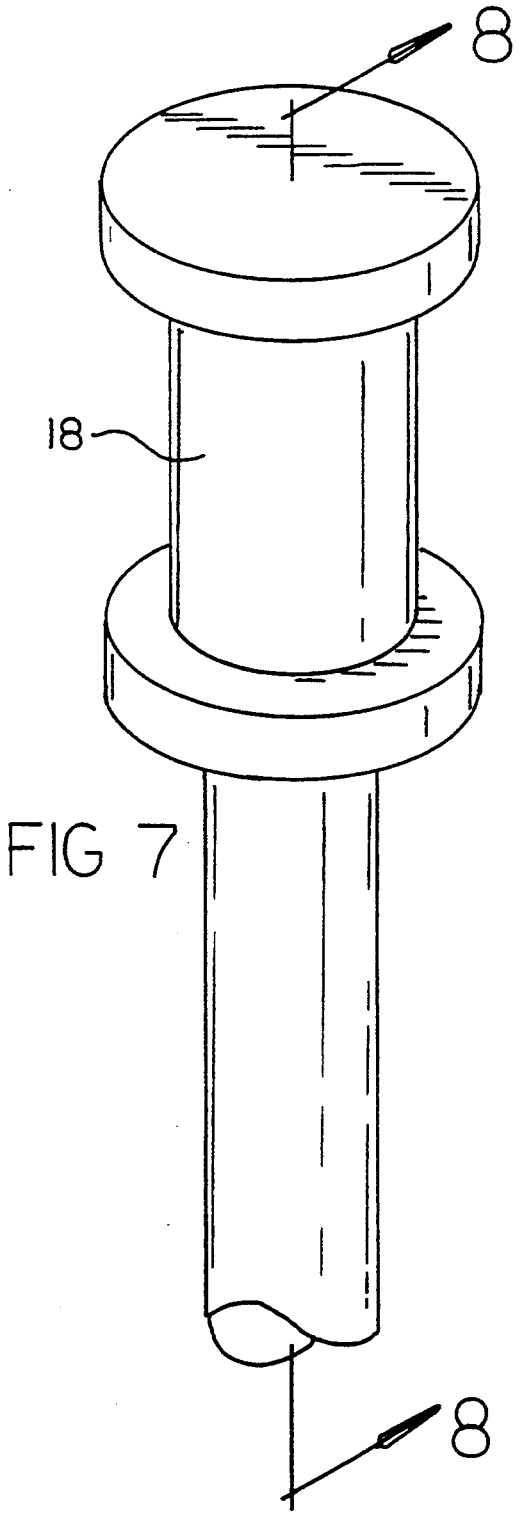
FIG. 7 is a perspective illustration of the upper extent of the device of FIGS. 1 and 4.
Figure 8:
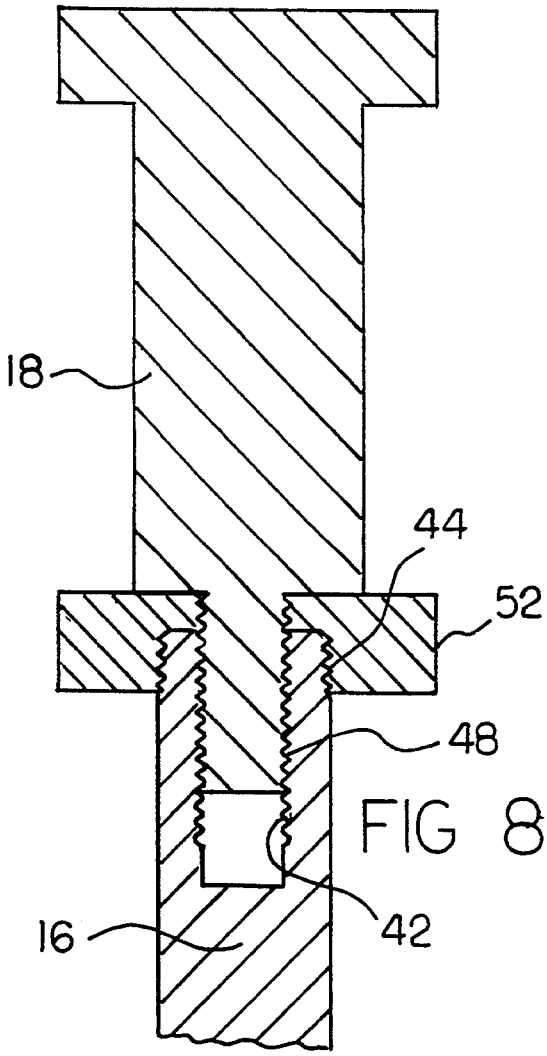
FIG. 8 is a cross-sectional view taken along line 8—8 of FIG. 7.

An alternate embodiment of the invention is shown in FIGS. 5 and 6. In such embodiment, a spike tip 58 is positioned at the lower end of the lower rod 12. External screw threads 59 are located thereabove. An attachment component 60 with a chisel point 62 is also provided. The attachment component has a recess 64 at its upper extent with internal screw threads 66 engagable by the threads 59 above the spike tip for coupling therebetween. The tool 10 is thus provided with extended utility.

The present invention is designed to serve as a combination crowbar and hammer. It is comprised of two coaxially sliding members and a spring. The inner member is a solid shaft made with a chisel-shaped end and it has a circular flange which serves as a spring seat. The outer member is tubular in shape and has a circular flange at its top which seats the other end of the spring. An internal stop controls the position to which the chisel end is extended with the compression spring in its pre-loaded position.

In use, one simply grasps the upper end of the tubular section and plunges it sharply downward to impart a hammer-like blow to any area contacted by the chisel. This compresses the spring, and when pressure is subsequently released, the tubular member is returned to its original position and is ready for the next applied hammering stroke. Sliding type hammers are commonly available and, of course, so are a variety of chisels; however, they are not available in one common tool and therein lies the innovation in the present invention. Further, the present invention can also be used as a prying bar.

It is ideal for use in any type of construction and will easily sever a bolt set in concrete. In some cases, two people are required to perform a job, one to hold a heavy bar and the other to deliver the hammer blow. The present invention can be handled by one person completely eliminating the need for this dangerous practice. It can be simply fabricated, lends itself readily to high volume production and can be inexpensively manufactured.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved one piece combination chisel/hammer/crowbar device comprising, in combination:

a linear lower rod of a solid circular cross-sectional configuration fabricated of a rigid hard material and having an upper end and a lower end with a planar striking surface at the upper end and a linear chisel point at the lower end;

a hollow tube with a circular cross-sectional configuration fabricated of a rigid hard material and having an upper end and a lower end with external threads at its upper end, the interior diameter being such as to be slidably received over the linear lower rod at the lower end of the tube and an apertured cap having internal screw threads positionable over the upper end of the tube and providing a bearing surface on the lower edge thereof;

a linear upper rod of a solid cross-sectional configuration fabricated of a rigid hard material and having an upper end and a lower end with the lower end having an enlarged head with a planar striking surface for striking the striker surface, the enlarged head being such as to be slidably received within the tube with the upper end of the upper rod extending above the upper end of the tube, the upper end of the upper rod being formed with internal threads and external threads;

an enlarged handle having external threads at its lower end threadedly received in the screw threads at the upper end of the upper rod and an enlarged collar at its upper end and a nut with enlarged threads receiving the exterior threads of the upper rod and reduced threads receiving the external threads of the handle; and a spike tip positioned at the lower end of the lower rod with external threads located thereabove and a removable attachment component with the chisel point, the attachment component having a recess at its upper extent with internal screw threads engagable by the external threads above the spike tip for coupling therebetween.

2. A one piece combination chisel/hammer/crowbar device comprising:

a linear lower rod of a solid circular cross-sectional configuration fabricated of a rigid hard material and having an upper end and a lower end with a planar striking surface at the upper end and a linear chisel point at the lower end;

a hollow tube with a circular cross-sectional configuration fabricated of a rigid hard material and having an upper end and a lower end with external threads at its upper end, the interior diameter being such as to be slidably received over the linear lower rod at the lower end of the tube and an apertured cap having internal screw threads positionable over the upper end of the tube and providing a bearing surface on the lower edge thereof;

a linear upper rod of a solid cross-sectional configuration fabricated of a rigid hard material and having an upper end and a lower end with the lower end having an enlarged head with a planar striking surface for striking the striker surface, the enlarged head being such as to be slidably received within the tube with the upper end of the upper rod extending above the upper end of the tube, the upper end of the upper rod being formed with internal threads and external threads; and an enlarged handle having external threads at its lower end threadedly received in the screw threads at the upper end of the upper rod and an enlarged collar at its upper end and a nut with enlarged threads receiving the exterior threads of the upper rod and reduced threads receiving the external threads of the handle.

3. The device as set forth in claim 2 and further including:

a spike tip positioned at the lower end of the lower rod with external threads located thereabove and a removable attachment component with the chisel point, the attachment component having a recess at its upper extent with internal screw threads engagable by the external threads above the spike tip for coupling therebetween.

* * * * *